US007513285B2

(12) United States Patent
Gambini

(10) Patent No.: US 7,513,285 B2
(45) Date of Patent: Apr. 7, 2009

(54) GLUING DEVICE OF AN END EDGE OF A LOG AND RELATIVE GLUING METHOD

(76) Inventor: Giovanni Gambini, Via A. Omodeo, 7-I-56124 Pisa (IT)

( * ) Notice: Subject to any disclaimer, the term of this patent is extended or adjusted under 35 U.S.C. 154(b) by 594 days.

(21) Appl. No.: 11/255,815

(22) Filed: Oct. 21, 2005

(65) Prior Publication Data

US 2006/0086860 A1 Apr. 27, 2006

(30) Foreign Application Priority Data

Oct. 26, 2004 (IT) ..... MI2004A2040

(51) Int. Cl.
*B65H 81/00* (2006.01)
*B32B 37/00* (2006.01)

(52) U.S. Cl. ..... 156/446; 156/184; 156/449; 156/450

(58) Field of Classification Search ..... 156/184, 156/446, 449, 450
See application file for complete search history.

(56) References Cited

U.S. PATENT DOCUMENTS 5,242,525 A * 9/1993 Biagiotti ..... 156/446
5,681,421 A * 10/1997 Biagiotti ..... 156/446
5,800,652 A * 9/1998 Vigneau et al. ..... 156/184
6,372,064 B1 4/2002 Butterworth et al.
6,620,241 B2 * 9/2003 Gambini ..... 156/446

FOREIGN PATENT DOCUMENTS

EP 1440925 A 7/2004
JP 50-35562 A * 11/1975
WO WO 2004/046006 A 6/2004

* cited by examiner

*Primary Examiner*—Jeff H Aftergut
(74) *Attorney, Agent, or Firm*—James V. Costigan; Hedman & Costigan, P.C.

(57) ABSTRACT

A gluing device of an end edge of a log in a machine for producing logs, wherein logs (14) delivered from being formed are fed on an inclined surface (13) disposed under an upper conveyor belt (17) towards a suction roller (18), connected to a vacuum source, the gluing device having a glue applicator (23, 24) disposed downstream of the suction roller (18), in which device the glue applicator comprises a glue picking up member (24) in a container below (23), which can move engaged between a position immersed in the glue and a position engaged with an end edge (19) of a log (14) disposed unwound on the suction roller (18).

6 Claims, 4 Drawing Sheets

GLUING DEVICE OF AN END EDGE OF A LOG AND RELATIVE GLUING METHOD

The present invention relates to a gluing device of an end edge of a log and relative gluing method.

In the field to produce rolls of paper for domestic use, toilet paper and the like, usually known as "logs", different more or less complex devices are provided to glue an end edge of a log, after it has finished being wound.

In fact, in general, once the paper has been wound, glue must be placed to obtain a stable connection of the end edge of the paper of each log, before performing the final cut into rolls of the required size.

Over the last decades, various methods of placing glue have been implemented for this purpose, such as dispensing glue by spraying, by making the edge or the roll travel over a slot (from which glue is dispensed dosed by overflow), with the roll picking up glue from an element carrying the glue, etc., once the end edge has been unwound by a portion thereof from the rest of the winding of paper produced.

Although functioning well, these known gluing devices for the final edges in general require specific times in order to place the glue, causing a loss of productivity.

Moreover, due to their nature, some of them either accidentally distribute glue also in areas in which it is not required, with soiling or in any case excess consumption thereof or, on the contrary, do not distribute it where it is actually required.

Often, another type of problem arises from the fact that some of these gluing devices of the end edge of a log are particularly complicated both from the viewpoint of construction and from the viewpoint of action performed between the various parts which make the log advance, the end edge unwind, at least for a portion thereof, and place the glue in the selected areas of the roll.

The principal object of the present invention is therefore to identify a solution to the aforesaid technical problems, both of rapid and correct dispensing or placing of the glue, and of precise and sufficient unwinding of the final edge in a gluing device of an end edge of a log.

Another object is to produce a gluing device which is as simple as possible both in structure and in operation, which can nonetheless provide satisfactory productivity.

These objects according to the present invention are obtained by producing a gluing device of an end edge of a log in a machine to produce logs, such as a gluing device of an end edge of a log in a machine for producing logs, wherein logs (14) delivered from being formed are fed on an inclined surface (13) disposed under an upper conveyor belt (17) towards a suction roller (18). connected to a vacuum source, said gluing device having a glue applicator (23. 24) disposed downstream of said suction roller (18). characterized in that said glue applicator comprises a glue picking up member (24) in a container below (23). which can move engaged between a position immersed in the glue and a position engaged with an end edge (19) of a log (14) disposed unwound on said suction roller (18).

Further important and particular characteristics of the invention include a glue picking up member (24) comprised of a central axle on which a glue collection element (25) extends radially outwards; or. in the alternative, that said glue collection element is in the form of a pad (25); or that said suction roller (18) has a delimited area in which writing or impressions (28) are disposed; or that said glue collection element (25) has a delimited area in which writing or impressions (28) are disposed; or that said delimited area in which writing or impressions (28) are disposed is produced by means of a strip of rubber material (31) applied to a respective supporting element (18. 25) or that it has means (21) to determine the length of said end edge (19) engaged on said suction roller (18).

The characteristics and advantages of a gluing device of an end edge of a log, in a machine to produce logs and of a respective gluing method according to the present invention will be more apparent from the description hereunder, provided as a non-limiting example, of an embodiment with reference to the appended figures wherein.

Figure 1:
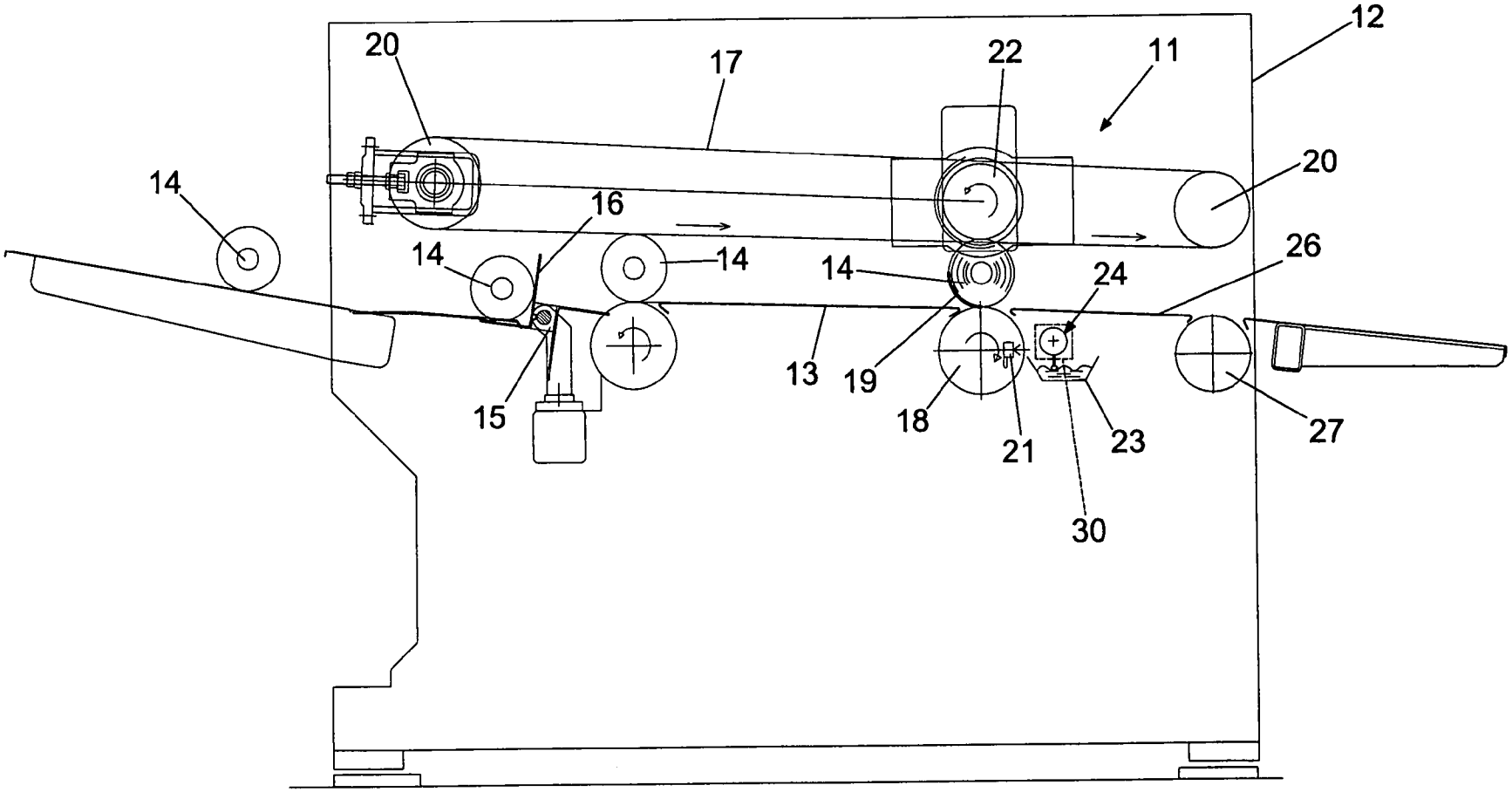
FIG. 1 is a schematic side elevation of a gluing device according to an embodiment of the present invention in a first operating position, in which the log is blocked between an unwinding roller and a conveyor belt.
Figure 2:
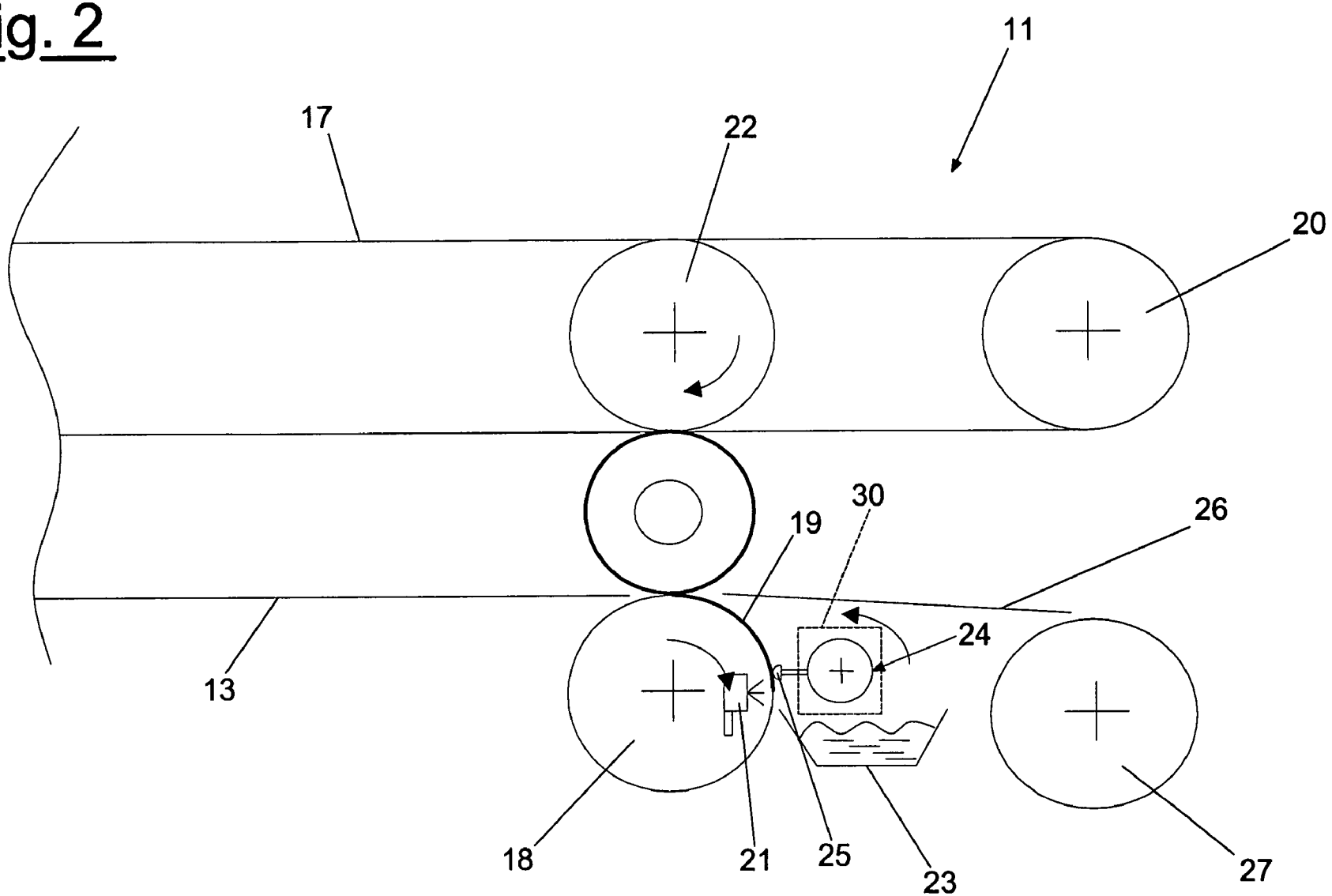
FIG. 2 is a view of an enlarged detail, entirely similar to the one in FIG. 1, in which the final edge of the log is in the opening phase to receive glue from the gluing device of the present invention.

With particular reference to FIGS. 1 and 2, these show a gluing device of an end edge of a log 11 disposed in a machine for forming logs. In particular, it is seen how a supporting structure of the machine 12 is provided with an inclined feed surface 13 by means of which logs 14, coming from a preceding rewinding machine (not shown) disposed upstream, are fed one after another.

In particular, as known, disposed at an end upstream of the inclined surface 13 is a rotating selector 15, of the star type, provided with a series of pockets 16, which receives the individual logs 14 to feed them one after another towards the subsequent gluing device according to the present invention. In particular, positioned over the inclined surface 13 is an upper conveyor belt 17 which cooperates therewith.

Moreover, the gluing device 11 also comprises a suction roller 18, connected to a vacuum source (not shown), which cooperates in the correct positioning of an end edge 19 of the log. The suction roller 18, which cooperates in unwinding a predefined length of the log, is independently motorized and is positioned below said upper conveyor belt 17, which extends in a ring between end pulleys 20. The length of the end edge 19 is determined as a function of the diameter of the suction roller 18 and of any specifications requested by the user. Optionally, although not necessarily, means can be provided to cooperate with the suction roller 18, to determine the length of the end 19 engaged on the suction roller 18, such as readers in the form of photocells 21.

Disposed above the suction roller 18 is an upper roller 22 which cooperates in receiving the log 14 and placing it in the desired position making it roll and, moreover, determining unwinding of the end edge 19.

Placed immediately downstream of the suction roller 18 is a glue applicator comprising a glue container 23, placed inside which is a glue picking up member 24. This picking up member 24 can be moved from a position immersed in the glue of the container 23 and a position engaged with the end edge 19 of a log disposed on the suction roller 18 under the upper roller 22.

In the glue container 23 the glue picking up member 24 has a central axle on which a glue collection element, such as a pad 25, motorized in 30, extends radially outwards.

Downstream of the suction roller 18 is a second surface 26, detached from the same roller 18, which allows the passage of an end edge 19 of a log held on the suction roller 18. The second surface 26 also receives the log, once the end edge 19 thereof has received the glue and has been rewound to remain stable on the log in a roll. Moreover, downstream of this second surface 26 there may be a lower roller 27 which cooperates with the upper belt 17 and guarantees final winding of the edge 19 on the log thus formed. Alternatively, not shown, the belt 17 can terminate sooner and a second roller, identical to the first roller 27, can be provided.

Operation of a gluing device according to the present invention is as follows.

The wound logs 14, one after another, are placed between the inclined feed surface 13 and the upper conveyor belt 17.

In this way the individual logs 14 are fed towards the suction roller 18 until reaching the point between said suction roller 18 and an upper roller 22 which cooperates in receiving the log 14. In this position the log 14 is rotated by means of the two rollers 18 and 22 to take a position with the end of the final edge 19 disposed at six o'clock.

It is obvious that this position with the end of the final edge 19 disposed at six o'clock can also be obtained through a first placing in phase by means of a first feed roller 32 placed at the beginning of the inclined surface 13 or, in any case, by providing a second phasing roller 33, placed in an intermediate area of the inclined surface 13, which performs re-phasing of the final edge 19 before the log is taken between the suction roller 18 and the upper roller 22.

In any case, from this position the two rollers 18 and 22, once the log 14 has been taken or received with the end of the final edge 19 disposed at six o'clock, by rotating clockwise, they determine unwinding of a predetermined quantity of the final edge 19 on the suction roller 18. Alternatively, the length of this final edge 19 can be determined by the action of the photocell 21 provided for this purpose, which halts rotation once the required length has been reached. Simultaneously to this movement the glue picking up member 24 is rotated counter-clockwise to position the pad 25 on top of the final edge 19, providing it with glue.

After this operation has terminated, the suction roller 18 halts the rotation thereof completely and the upper roller 22 inverts the direction of rotation thereby causing ejection of the log 14 towards the second surface 26. Rolling of the log 14 on this second surface 26 determines gluing thereof on top of the surface of the body of said log.

An operation of this type is extremely rapid and accelerates correct placing of the glue on the log, favoring completion of production thereof before the subsequent operations to cut it into small rolls of the required dimensions.

It is obvious that the glue picking up member 24 carrying the pad 25 must rotate in phase with the rotation of the suction roller 18 which acts as a roller to open the final edge 19.

In this way the problems set forth above related to the position of glue on logs according to prior art are solved.

Figure 3:
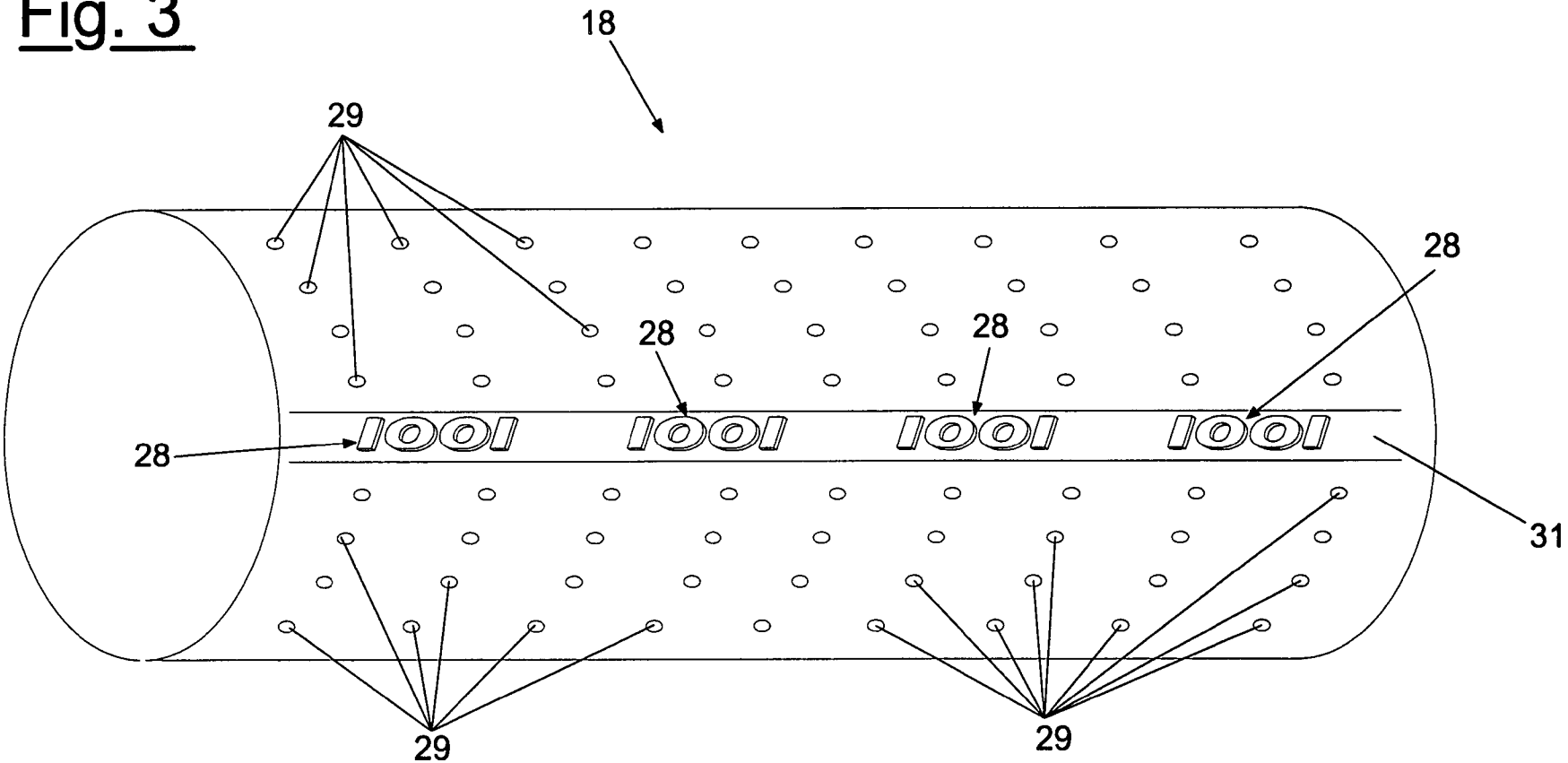
FIG. 3 is an enlarged perspective view of a suction roller which can be disposed to cooperate with the aforesaid gluing device.

FIG. 3 shows a view of the suction roller alone in a particular embodiment thereof. In fact, the suction roller 18 which has on the outer surface thereof a series of suction perforations 29, also has a delimited area provided with a strip of rubber material 31, of the "clichés" type, bearing writing or impressions 28, for example in relief.

In this way, the suction roller 18 produces writing or a logo on the paper during the phase to apply the glue by means of the pad 25, which customizes the rolls subsequently produced by cutting of the log.

This customizing takes place at the level of the area in which the glue is placed and the final edge 19 is provided with writing or a logo 28 which is embossed in the paper of the final edge 19 which is blocked on the surface of the suction roller 18.

Figure 4:
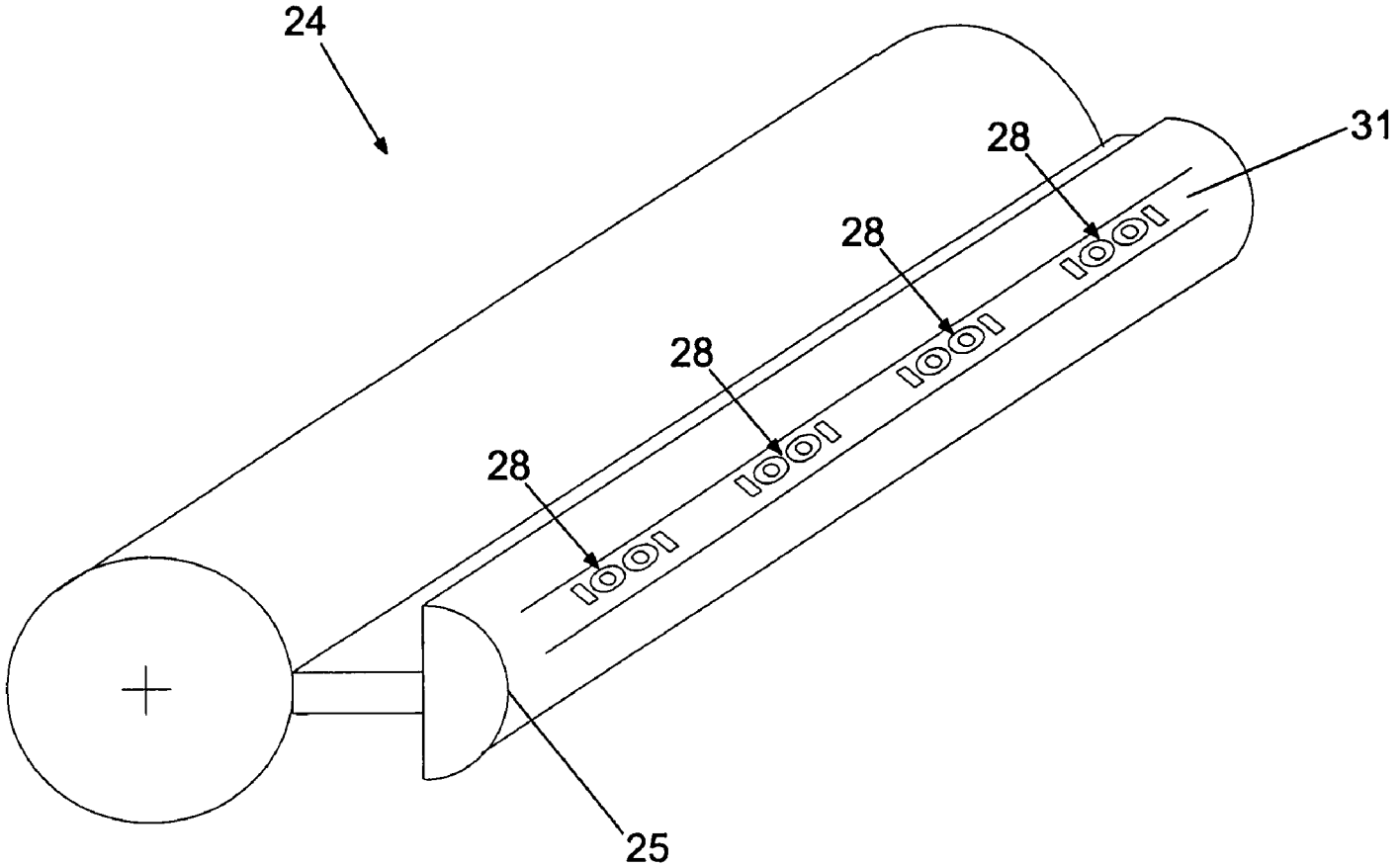
FIG. 4 is a perspective view of a pad element which can be used in a gluing device according to an embodiment of the present invention.

FIG. 4 shows a possible configuration of the pad 25 on which writing or the like 28 are produced directly, and which cooperate with the rubber surface of the suction roller 18 to create customized patterns on the paper, during the phase to deposit the glue on the final edge 19 of said paper.

In this way, with an extremely simple gluing device it is possible to perform gluing of the final edge as required.

Glue is thereby correctly placed on the final paper edge of a log to glue it, rapidly and precisely, to the side surface of said log.

In this way, the problems indicated in the introductory part relative to prior art gluing devices used in the field of logs to produce rolls of toilet tissue, paper for domestic use and the like have been solved.

The gluing device of the present invention thus conceived is susceptible to numerous modifications and variants, all falling within the scope of the invention. Moreover, in practice the materials used, and the dimensions and components thereof, may be any in accordance with technical requirements.

The invention claimed is:

1. Gluing device of an end edge of a log in a machine for producing logs, wherein logs (14) delivered from being formed are fed on an inclined surface (13) disposed under an upper conveyor belt (17) towards a suction roller (18), connected to a vacuum source, said gluing device having a glue applicator (23, 24) disposed downstream of said suction roller (18), characterized in that said glue applicator comprises a glue picking up member (24) in a container below (23), which can move engaged between a position immersed in the glue and a position engaged with an end edge (19) of a log (14) disposed unwound on said suction roller (18), characterized in that said suction roller (18) has a delimited area in which writing or impressions (28) are disposed.

2. Gluing device as claimed in claim 1, characterized in that said glue picking up member (24) comprises a central axle on which a glue collection element (25) extends radially outwards.

3. Gluing device as claimed in claim 2, characterized in that said glue collection element is in the form of a pad (25).

4. Gluing device as claimed in claim 2, characterized in that said glue collection element (25) has a delimited area in which impressions (28) are disposed.

5. Gluing device as claimed in claim 1, characterized in that said delimited area in which writing or impressions (28) are disposed is produced by means of a strip of rubber material (31) applied to a respective supporting element (18, 25).

6. Gluing device as claimed in claim 1, characterized in that it has means (21) to determine the length of said end edge (19) engaged on said suction roller (18).

* * * * *